United States Patent [19]

Salger

[11] 4,241,695

[45] Dec. 30, 1980

[54] ELECTROSTATIC DEVELOPING APPARATUS INCLUDING POWDER PROPELLING MEANS

[75] Inventor: Werner Salger, Hamburg, Fed. Rep. of Germany

[73] Assignee: Lumoprint Zindler KG (GmbH & Co.), Hamburg, Fed. Rep. of Germany

[21] Appl. No.: 870,226

[22] Filed: Jan. 17, 1978

[30] Foreign Application Priority Data

May 12, 1977 [DE] Fed. Rep. of Germany ..... 2721424

[51] Int. Cl.[3] ..... G03G 15/09

[52] U.S. Cl. ..... 118/658; 118/612

[58] Field of Search ..... 118/612, 653, 654, 655, 118/656, 657, 658; 355/3 DD; 366/292, 297, 300, 315, 317; 427/18

[56] References Cited

U.S. PATENT DOCUMENTS

| | | | |
|---|---|---|---|
| 2,616,340 | 11/1952 | Knoll | 366/315 X |
| 2,793,837 | 5/1957 | Goldman | 366/315 X |
| 3,640,248 | 2/1972 | Nielander | 118/658 |
| 3,828,730 | 8/1974 | Yamashita et al. | 118/658 |
| 3,900,255 | 8/1975 | Yamamoto | 118/655 |
| 4,022,157 | 5/1977 | Rasekhi et al. | 118/658 |
| 4,026,241 | 5/1977 | Takebe et al. | 118/612 |

FOREIGN PATENT DOCUMENTS

| | | | |
|---|---|---|---|
| 210744 | 8/1960 | Austria | 118/654 |

*Primary Examiner*—John P. McIntosh

*Attorney, Agent, or Firm*—Toren, McGeady and Stanger

[57] ABSTRACT

A method for the generation of a brush of developer powder at a magnet cylinder of a developing apparatus in a copying machine, for the development of a latent image, generated particularly electrostatically wherein developer powder is being thrown at least partly directly at the magnet cylinder in distribution over the length of this magnet cylinder and optionally passing this brush through a narrow gap. In the developing apparatus at least one scoop wheel or one or several pairs of scoop wheels rotating in an inclined plane and being partly immersed in a supply of developer powder serve to throw developer powder at the magnet cylinder for the generation of the brush of developer powder thereon. With the scoop wheel may be associated a worm conveyor and baffles.

23 Claims, 6 Drawing Figures

ELECTROSTATIC DEVELOPING APPARATUS INCLUDING POWDER PROPELLING MEANS

Figure 1:
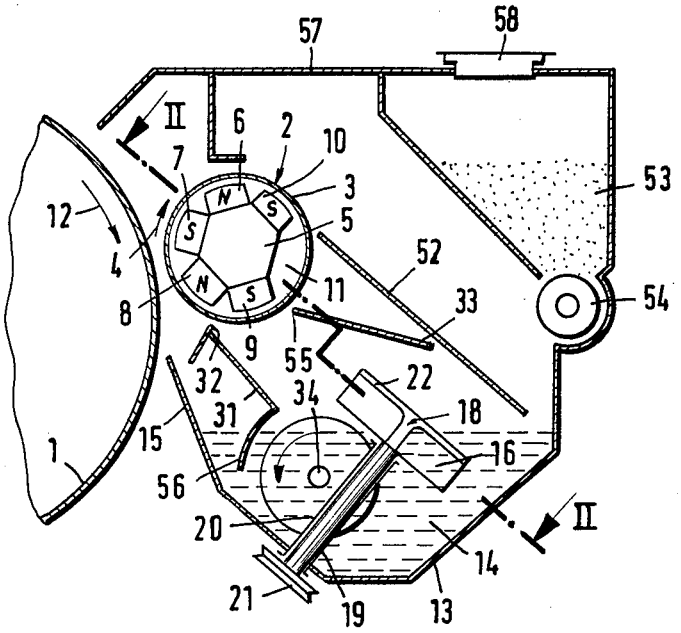

The present invention relates to an apparatus for the generation of a brush of developer powder at a magnet cylinder of a developing apparatus for the development of a particularly electrostatically generated latent image. Furthermore, the present invention relates to a developing apparatus including a developer powder brush on a magnet cylinder which is adapted to be moved in relative contact past a material carrying the latent image and being of a plane or particularly of a cylindrical configuration, and with means for feeding developer powder toward the magnet cylinder.

By the German Laying-Open specification DOS No. 2,224,624 is already known a developing apparatus in which for feeding developer powder toward the magent cylinder is provided an additional magnet cylinder or a so-called agitator. This agitator will only be employed when the magnet cylinder itself rotates at least partly within a supply of developer powder. In this heretofore known arrangement, the additional magnet cylinder likewise rotates within the supply of developer powder. In any case, developer powder is supplied evenly over the entire length of a trough-shaped supply reservoir that extends parallel of the magnet cylinder.

In the heretofore known arrangement the magnet systems are stationary, and external sleeve tubes are rotatingly driven. This heretofore known arrangement as well as other heretofore known arrangements of this type have the drawback that the feed of developer powder must be provided over the entire axial length of the magnet cylinder at which the brush of developer powder is generated. This drawback is quite substantial because it is likewise required that the developer powder will be replenished along the entire width of the apparatus. In addition, there arises the further drawback that in operation the developer powder mixture consisting of carrier and color particles varies along the length of the magnet cylinder or the width of the apparatus respectively, and no permanent uniform condition of the developer powder brush may be obtained even when feeding replenishment material.

An additional magnet cylinder rotating within the supply of developer powder entrains the further drawback that the powder will be compressed at its free surface, in forming a compacted surface trough from which the transfer of powder is impeded.

It has already been proposed in an earlier patent application by Applicant's U.S. Pat. No. 4,144,839 to employ a baffle and to throw the developer powder toward this baffle and toward the magnet cylinder. For this end, there has been proposed a pump for initially feeding the developer powder to a certain height. This proposed arrangement has the advantage of an inherently more simple design, and there is especially achieved the effect that throwing the developer powder onto the baffle interferes with the developer powder in a manner bearing on the adhesion of color particles on carrier particles, in inducing a condition between carrier and pigment particles which improves the sensitivity of the developer powder for developing even at weak stimulations.

In the already proposed arrangement as well as in the heretofore known arrangement the delivery volume of developer powder is relatively small. In the proposed arrangement the pump must be driven at a considerably high rotational speed which is not only uneconomical but may likewise interfere with the function of the pump because by immersion of a hopper the feed occurs in any moment only in a section, and there is no possibility of direct lateral feed of developer powder.

It is an object of the present invention to provide a novel and improved apparatus for the generation of a brush of developer powder.

It is another object of the present invention to provide a novel and improved developing apparatus.

It is a still further object of the present invention to provide an apparatus of the stated type which apparatus is improved in comparison to heretofore known apparatus for the generation of a brush of developer powder at a magnet cylinder.

It is still a further object of the present invention to improve a developing apparatus of the type as stated in the introductory part of the present specification by increasing the delivery volume by relatively simple expedients, in simultaneously reducing the rotational speed of the conveying element proper and wherein the conveying element within the supply simultaneously exerts an agitating effect which is favorable to the developer powder.

In accordance with the present invention, these objects are achieved in the apparatus by the fact that the developer powder is at least partly being thrown directly toward the magnet cylinder, in being distributed over the length of this cylinder. This unique characteristic results in a substantial delivery flow rate even at relatively low rotational speeds. Especially, additional conveying means are avoided, and by the throwing operation an extremely uniform feed of developer powder in a loosely scattered distribution is obtained.

In accordance with an advantageous modification, the quantity of developer powder thrown toward the magnet cylinder and being distributed along the length of this magnet cylinder is being passed through a gap by rotation of a part of the magnet cylinder, in further enhancing thereby a uniform distribution. In this manner may be obtained a uniform and light magnet brush which is a pre-requisite for a proper development.

For carrying out this method, the present invention proposes a developing apparatus having at least one scoop wheel that includes an angle to the horizontal, the scoop wheel dipping, by a section of its circumference, into a supply of developer powder and being mounted on a rotary shaft for rotation in a plane that is directed toward the magnet cylinder. In this manner, developer powder may be scooped directly from a supply of developer powder and may be thrown directly by the scooping movement, for generating a brush of developer powder. The increased delivery volume provided by this apparatus has the advantageous effect that the supply is continuously recirculated and intermixed. The direct arrangement of at least one scoop wheel allows to feed the magnet cylinder uniformly along its entire length, in an optimum performance, from a relatively short region in relation to the extent of the magnet cylinder.

Preferably, the plane in which the at least one scoop wheel rotates (rotary plane) intersects the magnet cylinder. In this manner the magnet cylinder of a particular configuration may be fed directly whereby it may be included that the caterpillar type magnet brush may be generated with the aid of a baffle, in providing at this baffle, upstream of the transition of developer powder into the magnet brush, a zone having the effect of a developer powder storage reservoir.

In a special embodiment of the present invention in which is employed a baffle as already proposed, a guide plate is associated with the baffle. This guide plate is disposed intermediate the at least one scoop wheel and the magnet cylinder and is inclined toward the baffle. This guide plate deflects part of the thrown developer powder onto the baffle and allows that part of the developer powder may slide downwardly along the upper surface of the baffle so as to arrive directly at the magnet cylinder. Suitably, an end edge of the guide plate facing the magnet cylinder coincides approximately with the rotary plane of the at least one scoop wheel, and the opposite end edge of the guide plate is spaced from this rotary plane and overlies the at least one scoop wheel. This arrangement provides, in combination with at least one scoop wheel, a shield which serves not only as a shield but additionally increases the sensitization of impacting developer powder and serves to remove excess developer powder.

Advantageously, the at least one scoop wheel is immersed in the supply of developer powder up to the hub portion of the scoop wheel. This arrangement provides particularly favorable conditions with regard to the scoop effect of the at least one scoop wheel, and the agitating movement within the supply and the throwing properties of the scoop wheel.

Most advantageously, the at least one scoop wheel includes throwing pockets which are covered toward the top. In this manner may be avoided that the at least one scoop wheel may throw developer powder upwardly into the space occupied by a supply reservoir. In a further suitable modification the at least one scoop wheel may consist of a disc with a downwardly depending star type assembly of radial projections. The disc constitutes an upper shield, and at the stated inclination of the at least one scoop wheel the star type assembly performs the agitating, scooping and throwing effects. In a suitable embodiment four bar-shaped projections may be provided. The capacity will be determined by the height of the bar-shaped projections. The bar-shaped projections may likewise be curved in cross-section, i.e. may be curved concavely in the throwing direction, in thus allowing focussing of the scooped out developer powder.

The inclination of the rotary plane of the scoop wheel depends upon the geometrical design of the developing apparatus. Advantageously, this rotary plane includes an angle of about 45° to the horizontal.

In a suitable embodiment, there may be provided at least one worm conveyor that extends along a supply reservoir in parallel to the magnet cylinder wherein the conveying elements of the worm conveyor feed developer powder to the at least one scoop wheel. In combination with the extremely efficient agitation movement of the at least one scoop wheel there will be obtained, in this manner, a particularly favorable recirculation of the developer powder within the supply reservoir.

Although at least one scoop wheel may be provided, a preferred embodiment of the present invention provides a pair of scoop wheels that are disposed in a substantially central region and are driven in opposite directions. In other words, pairs of scoop wheels are particualarly favorable, i.e. there may likewise be arranged four or six scoop wheels, depending upon the length of the developing apparatus whereby the two scoop wheels in every pair are driven in mutually opposite directions. In a developing apparatus for e.g. the sheet size DIN A4 two scoop wheels will be sufficient In a top view of the developing apparatus the two scoop wheels rotate in directions so that peripheral portions of the scoop wheels arrange below the magnet cylinder and facing toward the ends of the magnet cylinder within a trough-shaped supply reservoir rotate in directions toward the magnet cylinder. This expedient is advantageous insofar as developer powder will be thrown predominantly in an outward direction, i.e. toward the ends of the magnet cylinder at which the projected batches of powder will distribute over a greater length of the magnet cylinder, due to the angle of throw. Furthermore, major accumulations of developer powder in a central region and dissipating only slowly will be positively spread, loosened and separated. This arrangement avoids unfavorable preliminary stages of a triboelectric effect.

In an embodiment of this type the worm conveyor suitably does not include conveying elements intermediate the centrally disposed scoop wheels.

In accordance with another advantageous embodiment the worm conveyor includes conveying elements in the region intermediate the scoop wheels. These conveying elements are designed to convey developer powder toward the respective proximate scoop wheel. This arrangement allows to provide, by simple means, continuous recycling of developer powder along the whole length of the trough of a supply reservoir.

In a developing apparatus in which the magnet system includes pole sections of alternate polarities extending in parallel to the axial direction of the magnet cylinder whereby the magnet system is stationary, a special arrangement provides for an empty space in a region facing away from the brush of developer powder. This empty space is of particular significance to the throwing and removing of magnet powder when the magnet powder brush has moved past a recording material because in this manner will not only be facilitated the removal of developer powder that is possibly partially depleted of pigment particles proper but also the structure of the magnet brush formed of the thrown developer powder may be favorably influenced.

Preferably, the magnet cylinder includes a magnet system which is adjustably disposed within a sleeve tube. In this manner, the empty space between pole pieces may be adjusted with respect to the guide plate. Suitably, this empty space will be arranged substantially above the guide plate which is inclined downwardly from the magnet cylinder.

Figure 2:
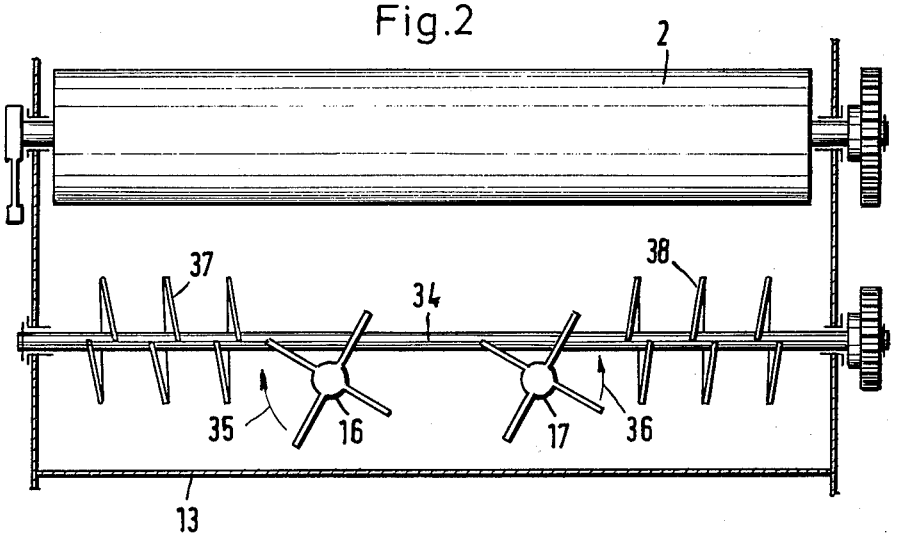
Figure 4:
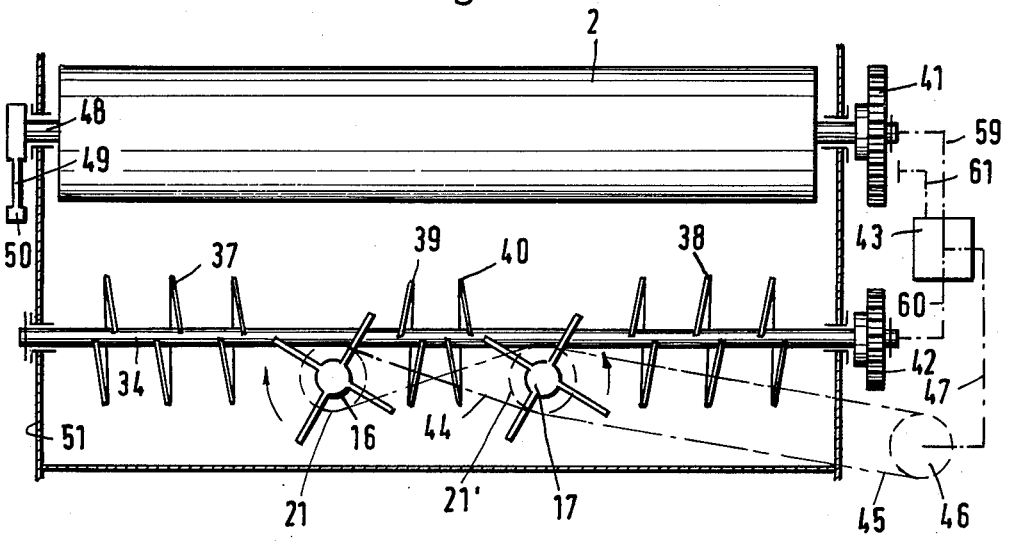
Figure 3A:
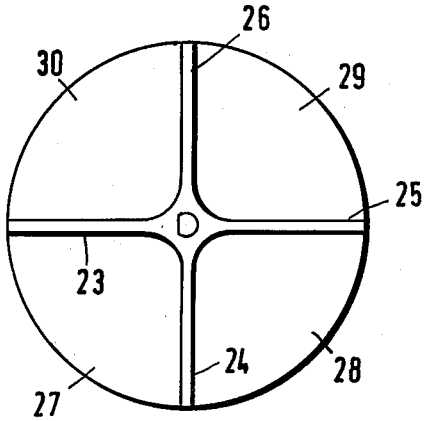
Figure 3B:
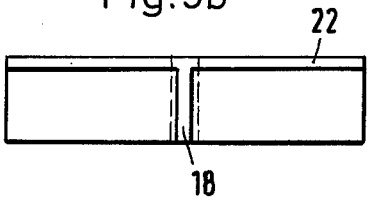
Figure 5:
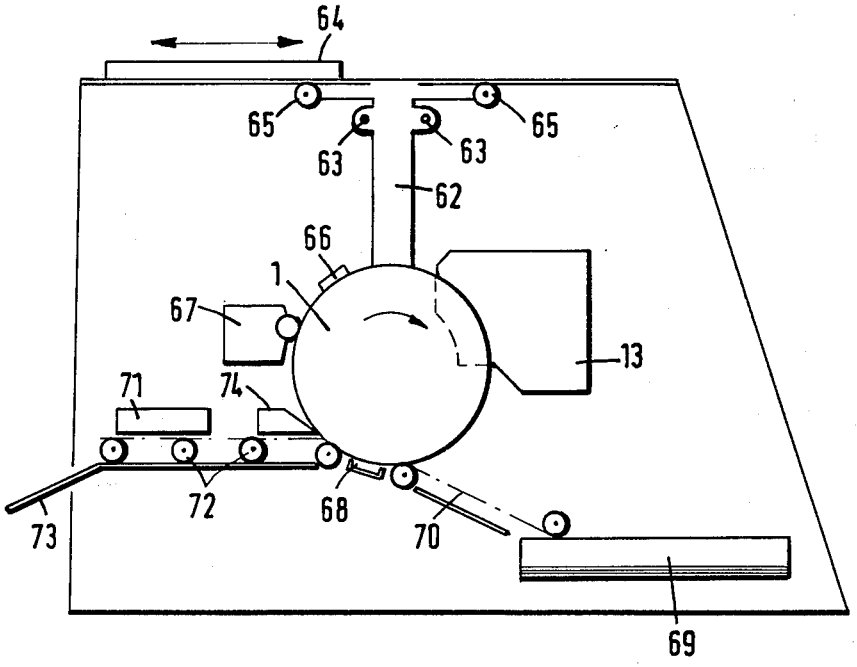

In the following, the present invention will be described more in detail with reference to several embodiments shown in the appended drawings wherein FIG. 1 is a schematic sectional side elevational view of a developing apparatus in accordance with the present invention;

FIG. 2 is a sectional view along the line II—II of FIG. 1;

FIG. 3*a* is a top view of a scoop wheel;

FIG. 3*b* is side elevational view of a scoop wheel;

FIG. 4 is a view similar to FIG. 2 but showing a modified embodiment of the present invention; and FIG. 5 is a schematic lateral elevational view of a copying apparatus.

It will be understood that the developing apparatus is part of a copying apparatus. Therefore, the present invention likewise relates to a copying apparatus for generating a latent image. The latent image may be generated and developed on a drum carrying a suitable coating.

In a copying apparatus as disclosed e.g. in the U.S. Pat. No. 3,062,108 a drum is e.g. coated with a selenium layer, and this selenium layer may also be enriched with other materials. On this layer, called here "material" is generated, by projection of an original, a latent image which will be developed by the described developing apparatus. It is known that for developing pigment particles will be deposited in accordance with existing forces of attraction on the material or the drum respectively, and the problem is to provide these pigment particles to the drum in a favorable manner.

Referring now to FIG. 1, there is shown a drum 1. A magnet cylinder 2 for developing purposes is associated with the drum 1. This magnet cylinder 2 includes a sleeve tube 3 made of the same material as stated in the heretofore known arrangement and driven for rotation in the direction of the indicated arrow 4. Within this sleeve tube 3 is disposed a magnet system generally designated 5 which is substantially stationary or adjustable in its peripheral direction. This magnet system 5 includes several pole sections 6 to 10 of alternating polarities extending parallel to the axis of the magnet cylinder 2. An empty space 11 is free from pole sections. This empty space 11 may be suitably adjusted in its position in a predetermined manner.

With respect to the direction of rotation of the sleeve tube 3 in the direction of the arrow 4, the drum 1 rotates, by its proximate region, in an opposite sense, as indicated by the arrow 12.

The developing apparatus includes a trough-shaped reservoir 13 in parallel to the magnet cylinder 2. A supply of developer powder 14 is provided in this reservoir 13 below the magnet cylinder 2. The magnet cylinder 2 is disposed in close proximity of the drum 1. A side wall portion 15 of the trough-shaped reservoir 13 extends close to the circumference of the drum 1 below the magnet cylinder 2.

Two scoop wheels 16, 17 are arranged underneath the magnet cylinder 2 and are disposed partly within the supply of developer powder 14. The scoop wheels 16, 17 are laterally displaced with respect to the magnet cylinder 2. The rotary plane of the scoop wheels 16, 17 coincides with the plane of the drawing of FIG. 2 and is suitably inclined at 45° to the horizontal. The scoop wheels 16, 17 are immersed in the supply of developer powder 14 up to the level of about their hubs 18. The scoop wheels are mounted on respective rotary shafts 19 which are sealed and shielded against the supply of developer powder by a sleeve 20 that projects beyond the supply reservoir 13. At the projecting ends of the rotary shafts 19 are mounted respective drive pulleys 21, 21'.

A scoop wheel will be explained with reference to FIGS. 1, 3*a* and 3*b*. The scoop wheels 16, 17 each include an upper circular disc 22 from which depend downwardly for example four bar-shaped projections 23 to 26. As may be seen in the drawings, these projections may be of a planar configuration. The projections may also be curved in the direction of rotation (not shown). These bar-shaped projections 23 to 26 define jointly with the disc 22 throwing pockets 27 to 30 respectively which are closed in their top portions by the disc 22.

The scoop wheels 16, 17 not only provide the throwing function by means of the outwardly tapering throwing pockets 27 to 30 but the disc 22 concurrently prevents developer powder that has been supplied from the supply 14 from rising upwardly in the direction of the shaft 19, in producing vortices which would not only constitute a waste of energy but likewise lead to a contamination of the whole environment within the apparatus.

Referring to FIG. 1, the scoop wheel 16 is illustrated at an inclination of about 45°. It may be seen that a baffle 31 extending along the whole length of the magnet cylinder is disposed therebeneath. The baffle 31 extends towards the circumference of the sleeve tube 3 and includes at its proximate end a projecting ridge 32 at which a thrown up supply quantity of developer powder may accumulate in forming a supply for the replenishment of a magnet brush at the sleeve tube. The magnet brush will then move into the narrow region between the sleeve tube and the drum 1. The baffle 31 inclines downwardly up to a point which is disposed above the supply of developer powder, and at this lower end may e.g. be provided a bent insert 56 which dips into the developer powder and is curved with a curvature concentric of the conveying elements.

A guide plate 33 extending along the whole length of the magnet cylinder is disposed above the scoop wheels 16, 17. An edge 55 of the guide plate 33 facing the magnet cylinder coincides approximately with the rotary plane of the scoop wheels 16, 17. The guide plate 33 inclines with this edge towards the baffle 31. In the here illustrated geometrical configuration, the guide plate 33 inclines from the magnet cylinder 2 downwardly so that developer powder dropping onto the upper surface of the guide plate may slide along this surface and then drop into the supply.

In the drawings is shown a worm conveyor 34 closely spaced below the scoop wheels 16, 17 and driven in the direction of the indicated arrow.

When the scoop wheels 16, 17 rotate as indicated by the arrows 35, 37 so that their outwardly disposed peripheral portions move toward the magnet cylinder 2, the worm conveyor 34 includes conveying elements 37, 38 in their sections disposed between the scoop wheels and the outer ends of the apparatus, as may be seen in FIG. 2. These conveying elements 37, 38 act on the supply of developer powder 14 and supply developer powder toward the scoop wheels 16, 17. The directions of rotation of the scoop wheels break up agglomerations of developer powder that may form in a center region by the profilings or bar-shaped projections 23 to 26.

According to FIG. 4 there may likewise be provided conveying elements 39, 40 in a center region of the worm conveyor 34. These additional conveying elements 39, 40 are designed to convey developer powder toward the respective proximate scoop wheel 16, 17, i.e. the conveying elements 39 feed material to the scoop wheel 16, and the conveying elements 40 feed material to the scoop wheel 17. This arrangement constitutes an additional means for loosening and conveying developer powder likewise in the region between the pair of scoop wheels 16, 17.

The magnet cylinder 2 may be driven by a gear wheel 41, and the conveyor 34 may be driven by a gear wheel 42. Both these gear wheels may in turn be driven by a common drive means 43.

The pulleys 21, 21' of the scoop wheels 16, 17 respectively may be interconnected by a crossed belt or a crossed chain 44 and may be driven, by means of a drive pulley 45 and a drive wheel 46 by the same drive means 43, e.g. via a bevel gear assembly, as indicated schematically by the functional connection 47.

The positioning of the magnet system 5 may be provided by a protruding stub shaft 48 and a pivot lever 49 having a detent 50 adapted to engage associated detent locking means (not shown) at the face side wall 51 of the trough-shaped supply reservoir 13. Toward this end, a pin may be slidably mounted in an end portion of the lever 49 and be adapted to engage a hole in an annular array of holes concentric of the stub shaft 48 (not shown).

The empty space 11 will advantageously be adjusted in a position located above the guide plate 33 and still below a protecting baffle 52 extending likewise along the whole width of the apparatus, i.e. substantially along the length of the magnet cylinder 2. This protecting baffle 52 inclines approximately from an upper section of the magnet cylinder downwardly toward the supply of developer powder 14 whereby this baffle is spaced from the rear side wall of the reservoir.

A make-up reservoir 53 with an associated metering dispenser 54 for the toner for replenishing the color particles of the developer powder is e.g. provided in the trough-shaped reservoir 13. The toner supplied from the make-up reservoir passes through the space at the lower end of the protecting baffle 52 and drops into the supply 14.

The supply reservoir 13 furthermore includes a top wall 57 with a closure 58 for the make-up reservoir 53. The top wall 57 extends up to a point in the close vicinity of the drum.

It may be understood that the drive means 43 is connected operationally not only by functional connections 59, 60 such as drive chains to the gear wheels 41, 42 but may likewise be connected, by a functional connection 61, to the drum-shaped metering dispenser 54 via a suitable gear reduction assembly (not shown).

For the better understanding of the present invention, the developing apparatus is shown in FIG. 5 in a copying apparatus. The developing apparatus with its trough-shaped reservoir 13 is associated with the drum 1. The drum rotates in the direction of the indicated arrow and may be exposed, through an exposure conduit 62, by means of conventional optics and light sources 63 shown merely schematically. Thereby an image of an original is transmitted while the original moves back and forth along the top surface of the apparatus in a carriage 64 that is driven by driving means 65.

Upstream of the exposure conduit 62 with respect to the direction of rotation of the drum are disposed in line a charging assembly 66, a cleaning assembly 67, a transfer station 68 (substantially at the underside of the drum) and the developing apparatus 13 of the present invention. From a supply 69 of receiving sheets such sheets are cyclically supplied to the transfer station 68 of e.g. a charging assembly by means of guide elements along a trajectory indicated schematically by the dash dotted line 70. The receiving sheets serve to receive the developed image and move subsequently into a fixing station 72 in which are provided suitable conveying elements 71 for feeding the sheets toward a discharge station 73. By the reference numeral 74 is designated a peeling aid for facilitating the peeling of the sheets off the drum 1. These components are shown merely schematically since these components and their operation are quite conventional.

The components extending along the whole length of the magnet cylinder such as the baffle 31 and the guide plate 33 are mounted at the face walls of the supply reservoir which also serves to journal the rotating components. The sleeves 20 for mounting the shafts 19 of the scoop wheels are mounted on the bottom wall of the supply reservoir. The throwing pockets 27 to 30 are open at their circumferential portions. The pole sections of the magnet system extend along the whole length of the magnet cylinder.

The sleeve tube of the magnet cylinder 2 may be driven by the right hand stub shaft as shown in FIG. 4 which is connected to the gear wheel 41. This stub shaft may for example cooperate with a face side wall or a spoke assembly of the sleeve tube 3. The opposite end of the sleeve tube may be mounted on the stub shaft 48 by means of the associate face side wall so as to be freely rotatable. The magnet system may be adjusted at the same side.

What is claimed is:

1. Electrostatic developing apparatus comprising: latent image carrier means; means defining a reservoir containing a supply of developer powder, said reservoir being arranged to have said powder supply normally contained therein not to exceed a maximum upper level; magnet cylinder means including a longitudinal axis and mounted proximate said latent image carrier means and located above said maximum upper level of said developer powder operative to entrain said developer powder to assist in bringing said powder into operative proximity with said latent image carrier means; and scoop wheel means including at least one scoop wheel and means for rotating said at least one scoop wheel about a scoop wheel axis, said scoop wheel axis being defined to extend at an angle with respect to the horizontal and transversely relative to the axis of said magnetic cylinder means, with said scoop wheel arranged to rotate about said scoop wheel axis within a plane extending toward said magnet cylinder means and generally parallel to the axis thereof; said scoop wheel means being arranged relative to said maximum upper level of said developer powder in said reservoir such that at least part of said scoop wheel is maintained immersed in said supply of developer powder.

2. Apparatus according to claim 1 wherein said scoop wheel is constructed to define a plurality of pockets extending radially relative to said scoop wheel axis, wherein said scoop wheel axis extends perpendicularly to said longitudinal axis of said magnet cylinder means, and wherein said scoop wheel is arranged such that rotation thereof operates to propel developer powder engaged within said pockets toward said magnetic cylinder means, said powder being thus propelled with a directional component extending along said longitudinal axis of said magnetic cylinder means.

3. Apparatus according to claim 1 wherein said scoop wheel is arranged for rotation about a rotary shaft with the plane of rotation of said scoop wheel being perpendicular to said scoop wheel axis and extending to intersect said magnet cylinder means.

4. Apparatus according to claim 1 further comprising a baffle member disposed within said reservoir beneath said magnet cylinder means and located intermediate said magnet cylinder means and said supply of developer powder, said baffle member being inclined upwardly from said supply of developer powder toward the periphery of said magnet cylinder means, with an end portion of said baffle member being spaced from said at least one scoop wheel, said baffle member being located so that developer powder from said supply of developer powder is thrown onto said baffle member by operation of said scoop wheel, and a guide plate operatively associated with said baffle member and mounted in said supply reservoir intermediate said at least one scoop wheel and said magnet cylinder means, said guide plate being inclined toward said baffle member with said guide plate partially extending above said scoop wheel.

5. Apparatus according to claim 4 wherein said guide plate includes an edge portion facing said magnet cylinder means, said edge portion being disposed in the rotary plane of said at least one scoop wheel, and a second opposite end portion of said guide plate extending at an increased spacing from said rotary plane beyond said at least one scoop wheel.

6. Apparatus according to claim 1 further comprising means for replenishing developer powder within said reservoir and for maintaining the level of said developer powder approximately at said maximum upper level, said at least one scoop wheel including a hub portion, with said scoop wheel means including a rotary shaft rotatably mounting said scoop wheel at said hub portion, said scoop wheel being arranged to have said hub portion located approximately at said maximum upper level of said developer powder in order to maintain said at least one scoop wheel immersed in said supply of developer powder at least up to said hub portion thereof.

7. Apparatus according to claim 1 wherein said at least one scoop wheel is structured with means defining a plurality of pockets adapted to engage therein said developer powder and to propel said developer powder in directions radially of said scoop wheel axis, said at least one scoop wheel including wall means defining said pockets with openings located at the outer periphery of said scoop wheel.

8. Apparatus according to claim 7 wherein said scoop wheel includes a disc-shaped wall member extending generally perpendicularly to said scoop wheel axis and a plurality of radial wall members arranged to extend radially from said scoop wheel axis and perpendicularly from said disc-shaped wall member, said disc-shaped wall member and said radial wall members defining therebetween said radially extending pockets.

9. Apparatus according to claim 1 wherein said at least one scoop wheel is mounted for rotation about said scoop wheel axis with said rotary plane of said scoop wheel being arranged so that it is inclined at an angle of about 45° relative to the horizontal.

10. Apparatus according to claim 1 further comprising longitudinal conveyor means operatively associated with said at least one scoop wheel, said longitudinal conveyor means operating to feed developer powder within said reservoir toward said at least one scoop wheel.

11. Apparatus according to claim 10 wherein said magnetic cylinder means comprises a longitudinal axis and wherein said longitudinal conveyor means also comprises a longitudinal axis which extends generally parallel to said longitudinal axis of said magnet cylinder means, said longitudinal conveyor means being arranged to be immersed within said developer powder and including spiral-like conveying elements operating to move said developer powder longitudinally of said longitudinal conveyor means upon rotative motion thereof.

12. Apparatus according to claim 11 wherein said at least one scoop wheel is located intermediate the longitudinal ends of said longitudinal conveyor means, wherein said spiral-like conveyor elements are located on either side of said at least one scoop wheel intermediate each longitudinal end of said longitudinal conveyor means and said at least one scoop wheel, and wherein said spiral-like conveyor elements operate to convey said developer powder longitudinally inwardly of said longitudinal conveyor means and away from each of the longitudinal ends thereof.

13. Apparatus according to claim 12 comprising a pair of scoop wheels located between said spiral-like conveying elements.

14. Apparatus according to claim 13 wherein said longitudinal conveyor means include spiral-like conveying elements located on said longitudinal conveyor means intermediate said pair of scoop wheels, said intermediate conveying elements operating to propel developer powder in opposite directions toward each of said pair of scoop wheels, respectively.

15. Apparatus according to claim 1 wherein said scoop wheel means comprises at least two scoop wheels, wherein said magnetic cylinder means is formed as a generally longitudinal member and wherein said at least two scoop wheels are located generally centrally of said longitudinal extent of said magnet cylinder means and are adapted to be rotatively driven in opposed rotary modes.

16. Apparatus according to claim 15 wherein each of said two scoop wheels is rotated so that peripheral portions of said scoop wheels move during said rotation thereof in directions toward said magnet cylinder means with respect to said reservoir.

17. Apparatus according to claim 16 wherein said two scoop wheels are arranged in juxtaposed position adjacent each other and wherein said scoop wheels are rotated so that the peripheral portions of each of said scoop wheels are moving toward said magnet cylinder means when said peripheral portions move on the side of each of said scoop wheels opposite the side on which said adjacent scoop wheel is located.

18. Apparatus according to claim 1 wherein said magnet cylinder means include a magnet system and a sleeve tube circumscribing said magnet system, said sleeve tube being rotatively driven, with said magnet system including pole portions of alternate polarities extending parallel to the axial direction of said magnet cylinder, said magnet system being stationary with at least one section of said magnet system along said axial extent of said magnet cylinder being provided with an empty space devoid of pole portions, said empty space being located in a region facing away from said latent image carrier means.

19. Apparatus according to claim 18 further comprising a guide plate mounted in said supply reservoir intermediate said at least one scoop wheel and said magnet cylinder means, said guide plate being inclined relative to the horizontal and extending partially over said at least one scoop wheel, said section of said magnet system where said empty space is provided being arranged substantially in a position overlying said guide plate with said guide plate extending downwardly from said magnet cylinder means.

20. Electrostatic developing apparatus comprising: latent image carrier means; means defining a reservoir containing a supply of developer powder, said reservoir being arranged to have said powder supply normally contained therein not to exceed a maximum upper level; magnet cylinder means mounted proximate said latent image carrier means and located above said maximum upper level of said developer powder operative to entrain said developer powder to assist in bringing said powder into operative proximity with said latent image carrier means; and scoop wheel means including at least one scoop wheel and means for rotating said at least one scoop wheel about a scoop wheel axis said scoop wheel axis being defined to extend at an angle with respect to the horizontal with said scoop wheel arranged to rotate about said scoop wheel axis within a plane extending toward said magnet cylinder means; said scoop wheel means being arranged relative to said maximum upper level of said developer powder in said reservoir such that at least part of said scoop wheel is maintained immersed in said supply of developer powder; said magnet cylinder means including a longitudinal axis, with said scoop wheel being constructed to define a plurality of pockets extending radially relative to said scoop wheel axis; said scoop wheel axis extending perpendicularly to said longitudinal axis of said magnet cylinder means with said scoop wheel being arranged such that rotation thereof operates to propel developer powder engaged within said pockets toward said magnetic cylinder means, said powder being thus propelled with a directional component extending along said longitudinal axis of said magnetic cylinder means.

21. Electrostatic developing apparatus comprising: latent image carrier means; means defining a reservoir containing a supply of developer powder, said reservoir being arranged to have said powder supply normally contained therein not to exceed a maximum upper level; magnet cylinder means mounted proximate said latent image carrier means and located above said maximum upper level of said developer powder operative to entrain said developer powder to assist in bringing said powder into operative proximity with said latent image carrier means; scoop wheel means including at least one scoop wheel and means for rotating said at least one scoop wheel about a scoop wheel axis, said scoop wheel axis being defined to extend at an angle with respect to the horizontal with said scoop wheel arranged to rotate about said scoop wheel axis within a plane extending toward said magnet cylinder means; said scoop wheel means being arranged relative to said maximum upper level of said developer powder in said reservoir such that at least part of said scoop wheel is maintained immersed in said supply of developer powder; a baffle member disposed within said reservoir beneath said magnet cylinder means and located intermediate said magnet cylinder means and said supply of developer powder, said baffle member being inclined upwardly from said supply of developer powder toward the periphery of said magnet cylinder means, with an end portion of said baffle member being spaced from said at least one scoop wheel, said baffle member being located so that developer powder from said supply of developer powder is thrown onto said baffle member by operation of said scoop wheel; and a guide plate operatively associated with said baffle member and mounted in said supply reservoir intermediate said at least one scoop wheel and said magnet cylinder means, said guide plate being inclined toward said baffle member with said guide plate partially extending above said scoop wheel; said guide plate including an edge portion facing said magnet cylinder means, said edge portion being disposed in the rotary plane of said at least one scoop wheel, and a second opposite end portion of said guide plate extending at an increased spacing from said rotary plane beyond said at least one scoop wheel.

22. Electrostatic developing apparatus comprising: latent image carrier means; means defining a reservoir containing a supply of developer powder, said reservoir being arranged to have said powder supply normally contained therein not to exceed a maximum upper level; magnet cylinder means mounted proximate said latent image carrier means and located above said maximum upper level of said developer powder operative to entrain said developer powder to assist in bringing said powder into operative proximity with said latent image carrier means; and scoop wheel means including at least one scoop wheel and means for rotating said at least one scoop wheel about a scoop wheel axis, said scoop wheel axis being defined to extend at an angle with respect to the horizontal with said scoop wheel arranged to rotate about said scoop wheel axis within a plane extending toward said magnet cylinder means; said scoop wheel means being arranged relative to said maximum upper level of said developer powder in said reservoir such that at least part of said scoop wheel is maintained immersed in said supply of developer powder; said at least one scoop wheel being structured with means defining a plurality of pockets adapted to engage therein said developer powder and to propel said developer powder in directions radially of said scoop wheel axis; said at least one scoop wheel including wall means defining said pockets with openings located at the outer periphery of said scoop wheel, a disc-shaped wall member extending generally perpendicularly to said scoop wheel axis and a plurality of radial wall members arranged to extend radially from said scoop wheel axis and perpendicularly from said disc-shaped wall member, said disc-shaped wall member and said radial wall members defining therebetween said radially extending pockets.

23. Electrostatic developing apparatus comprising: latent image carrier means; means defining a reservoir containing a supply of developer powder, said reservoir being arranged to have said powder supply normally contained therein not to exceed a maximum upper level; magnet cylinder means including a longitudinal axis and mounted proximate said latent image carrier means and located above said maximum upper level of said developer powder operative to entrain said developer powder to assist in bringing said powder into operative proximity with said latent image carrier means; scoop wheel means including a pair of scoop wheels and means for rotating each of said scoop wheels about an individual scoop wheel axis, said axes of each of said scoop wheels being defined to extend at an angle with respect to the horizontal with said scoop wheels arranged to rotate about each of said scoop wheel axes, respectively, within a plane extending toward said magnetic cylinder means; said scoop wheel means being arranged relative to said maximum upper level of said developer powder in said reservoir such that at least part of each of said scoop wheels is maintained immersed in said supply of developer powder; and longitudinal conveyor means arranged to be immersed within said developer powder and operating to feed developer powder within said reservoir toward said scoop wheel means; said longitudinal conveyor means comprising a longitudinal axis which extends generally parallel to said longitudinal axis of said magnet cylinder means and spiral-like conveying elements located on either side of said scoop wheels and operating upon rotation thereof to convey said developer powder in opposite directions longitudinally of said longitudinal conveyor means toward said scoop wheel means.

* * * * *